United States Patent [19]

Patel

[11] Patent Number: 4,963,842

[45] Date of Patent: Oct. 16, 1990

[54] MILLIMETER WAVE FIN-LINE GAS DISCHARGE RECEIVER PROTECTOR

[75] Inventor: Sumantrai D. Patel, Silver Spring, Md.

[73] Assignee: Westinghouse Electric Corp., Pittsburgh, Pa.

[21] Appl. No.: 490,537

[22] Filed: Mar. 5, 1990

Related U.S. Application Data

[63] Continuation of Ser. No. 286,399, Dec. 19, 1988, abandoned.

[51] Int. Cl.[5] ..... H01P 1/14

[52] U.S. Cl. ..... 333/13; 315/39

[58] Field of Search ..... 333/13; 315/39

[56] References Cited

U.S. PATENT DOCUMENTS

| | | | |
|---|---|---|---|
| 3,781,719 | 12/1973 | Darkee | 333/13 |
| 4,027,255 | 5/1977 | Blakeney et al. | 333/13 |
| 4,245,197 | 1/1981 | Goldie | 333/13 |
| 4,816,785 | 3/1989 | Carlisle et al. | 333/13 X |

*Primary Examiner*—Paul Gensler

*Attorney, Agent, or Firm*—W. G. Sutcliff

[57] ABSTRACT

A passive, broadband, millimeter wave, fin-line, gas discharge device operable for use in a radar system as a receiver protector. The preferred embodiment of this device comprises: a rectangular waveguide housing having a free electron emitting radioactive primer mounted upon one interior wall, an inert gas under pressure contained within the housing by two thin, low loss dielectric windows at opposing ends of the waveguide housing, and two bevelled, tapered fins operable to provide a narrow discharge gap region. Incident ratio frequency signals entering the radar system pass through the fin-line receiver protector. Signals entering the waveguide housing through the thin dielectric windows excite the free electrons causing the electrons to collide with the inert gas molecules. A spontaneous breakdown of gas occurring in the narrow discharge gap region between the two bevelled, tapered fins greatly attenuates the incident ratio frequency signal from entering the receiver thereby protecting it. Embodiments for board band, narrow band, low power and high power applications are described.

39 Claims, 5 Drawing Sheets

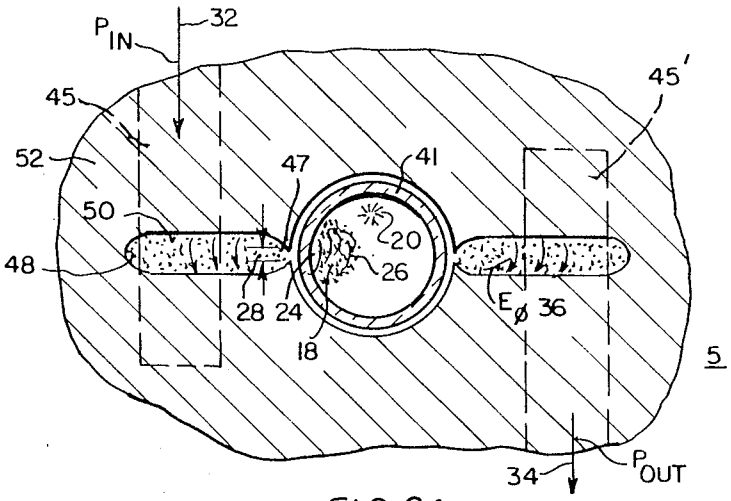
FIG. 6A.
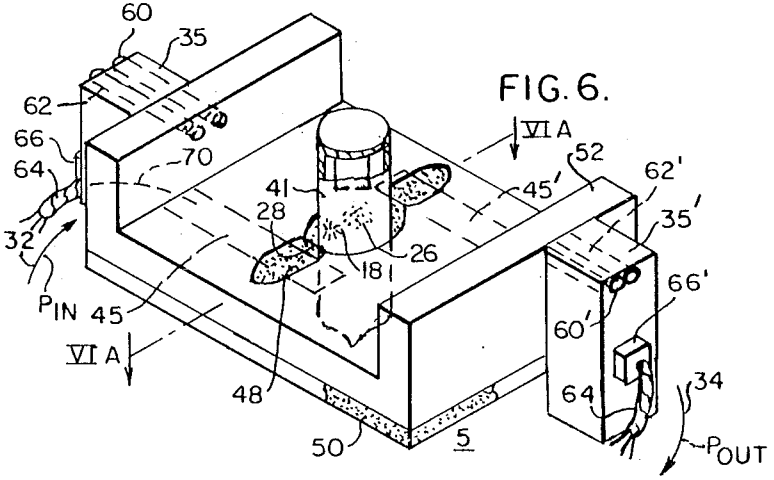
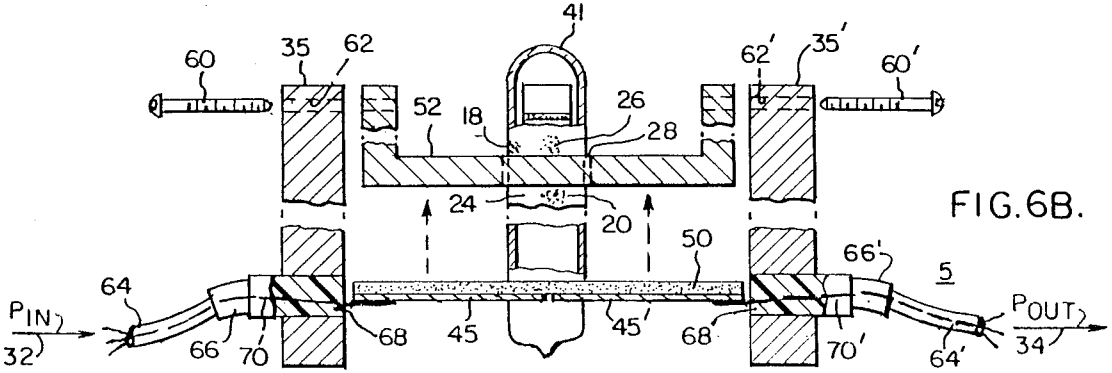

MILLIMETER WAVE FIN-LINE GAS DISCHARGE RECEIVER PROTECTOR

This application is a continuation of application Ser. No. 286,399 filed Dec. 19, 1988, now abandoned.

BACKGROUND OF THE INVENTION

1. Field of the Invention:

The present invention relates to a millimeter-wave, fin-line, passive, gas discharge device operable as a radar receiver protector. This gas discharge device utilizes; a hermetically sealed, gas filled housing, a radioactive primer and two parallel, bevelled, tapered fins to produce an electrical gas discharge thereby protecting a radar receiver by blocking an incident radio frequency signal. Broadband and narrow band embodiments are described utilizing inert and reactive gases in the vacuum sealed housing.

2. Description of the Prior Art:

A receiver protector is well known in the prior art and many examples of this art may be found in United States patents.

The U.S. Pat. No. 2,972,083 issued Feb. 14, 1961 to inventor R. M. Walker et al. entitled "Sealing Waveguide Window", detailed a window for use with hermetic, high-vacuum type seals for the controlled propagation of electromagnetic energy in waveguides. This invention did not claim the use of an inert gas and radioactive primer with bevelled fin point discharge effectively stopping incident, millimeter wave, electromagnetic energy. An iris utilizing a gap electrode within the waveguide functioned as a transmit/receive "switch".

The patent to L. W. Roberts, U.S. Pat. No. 3,O72,865, issued Jan. 8, 1963 for a "Gaseous Discharge Device". This patent described a wideband, high frequency, gaseous discharge device or tube having sealed waveguide sections, and one or more resonant structures. This improved electrode structure supplied residual electrons adjacent to a discharge gap with a "keep alive" electrode structure comprising titanium tipped pellets. This device did not describe the fin-line housing, radioactive primer, bevelled fin-line gap critical to this application discharge. Further, the L. W. Roberts patent did disclose a waveguide structure operable in the wideband region providing a gaseous discharge over a narrow gap or ionizing electrodes. A window or iris functioned to input the incident electromagnetic energy.

The patent entitled, "Variable Microwave Phase Shifter Utilizing A Plasma Electrode", issued Feb. 15, 1966 as U.S. Pat. No. 3,235,768, to H. Magnuski. This patent is for a device operable to shift the phase of microwaves in a waveguide. This electronic microwave phase shifter was operable to rapidly shift the phase of microwaves not unlike a "electronic on/off switch" for a waveguide. The ionization of gas in the waveguide by electrodes reflected the input signals either changing their phase or attenuating them. However this claimed device did not utilize the concepts of; a passive, radioactive, broad band discharge over bevelled fins.

A gas filled, electrical discharge device, or "transmit/receive switch", as used in radar at ultra short wave, for example, 3,000 mega cycles protecting a receiver from pulse feedback during transmission and operable over a wide range of incident ratio frequency power levels was the patent issued to J. D. Woermbke. This U.S. Pat. No. 3,268,757, issued Aug. 23, 1966 entitled, "Electrical Discharge Device", claimed an envelope structure with a discharge gap and gaseous atmosphere of chloride or helium, neon, argon, krypton, xenon, or radon all combined with iodine as operable to provide a "transmit/receive switch." However, this device unlike the subject invention did not claim the concept of a broad band, radioactive primed finned discharge gap. This "Electrical Discharge Device", patent to J. D. Woermbke is commonly assigned to the same assignee as this subject invention.

U.S. Pat. No. 4,027,255 dated May 31, 1977 entitled, "Fast Recovery Time Receiver Protector For Radars" as issued to Blakeney, described a waveguide type multi-stage receiver protector, wherein a chlorine gas discharge stage, combined with a radioactive primer device to provide a "transmit/receive switch" for pulse Doppler radar. The Blakeney device claimed a multistage passive receiver protector operable to protect radar receivers operating in a waveguide. The multistages comprised; a halogen gas discharge stage, a rapid start-up gas discharge with short recovery period, and a operational radioactive primer substrate. The radioactive primer was operable to provide the free electrons for initiating the gas discharge. However, discharge occurred throughout the multiplicity of successive stages.

The fin-line transmission line, is a preferred medium for millimeter wave radar applications because of its low insertion loss, wide band characteristics and the physically realizable circuits that are available at high frequencies. The configuration of a typical fin-line transmission line consists of; a low dielectric substrate material or sheet of narrow thickness having two metal "fins" printed on either side of the substrate. When the fins which are metallized on one side of the substrate it is referred to as a unilateral fin-line transmission line. While "fins" printed on both sides of the substrate material are considered a bilateral fin-line transmission line. In either embodiment, the fins should be separated by a narrow gap and grounded by enclosing the substrate sheet in a conventional rectangular waveguide enclosure.

Fin-line devices which are symmetrically mounted within the waveguide have conventional input and output ports using fin-line to waveguide transitions. Fin-line device performance is characterized in terms of the frequency band of the respective waveguide band in which the device operates, for example, Ka-band or Q-band. The microwave region is approximately 0.5-30GHz, while millimeter wave is considered greater than 30 GHz.

In the millimeter wave band range, no device was found as prior art which successfully achieved the protection from high peak powers and low insertion loss over a full waveguide band using a wide band plasma stage device.

This device should be used as a front, high power, gas plasma stage in a hybrid gas diode, receiver protector, for millimeter wave radar systems. Further this device should offer a simple circuit configuration providing lower fabrication costs in lot production because of the minimization of the number of stages.

SUMMARY OF THE INVENTION

In accordance with the above requirements the present invention a passive, broad band, millimeter wave, fin-line, gas discharge device is operable for use as a radar receiver protector.

One embodiment of the device incorporates: a hermetically sealed, rectangular waveguide housing; two low loss dielectric windows, fixedly mounted into each end of the rectangular housing, both windows operable to transmit incident input and output radio frequency signals; a radioactive primer operable to emit within the hermetically sealed rectangular housing free electrons; inert, low pressure discharge gas fully contained within the rectangular housing, this gas having a multiplicity of free floating gas molecules; and, top and bottom bevelled, tapered metal fins fixedly mounted longitudinally within the rectangular housing opposing and parallel one to the other with a narrow discharge gap in the center. The input of an incident, radio frequency signal excite the emitted free electrons from the radioactive primer serve as a catalyst which results in a spontaneous gas breakdown of neutral gas molecules at a narrow discharge gap between the bevelled tapered fins. This gas discharge or arc between the fins greatly attenuated the passage of the incident input radio frequency signal, reflecting back towards the source, thereby protecting the radar receiver which is positioned behind the receiver protector.

Other embodiments of passive, millimeter wave, fin-line gas discharge devices incorporate protective glass envelopes within the rectangular housing, reactive or halogen gases, and rectangular or circular irises for operation in the narrow band range.

BRIEF DESCRIPTION OF THE DRAWINGS

For a better understanding of the invention reference may be had to the preferred embodiment exemplary of the invention, shown in the accompanying drawings, in which:

FIG. 6 is an isometric view of yet another alternative embodiment, a narrowband slot line, (S-band) plasma stage protector having a single resonator with a sealed, glass quartz tube; also having cross-section VIA—VIA FIG. 6A is a plan top view of FIG. 6, a slot line, (S-band) rectangular resonator, having a single circular resonator with a sealed, glass, quartz tube; and FIG. 6B is an exploded side view of the slot line, (S-band) plasma stage as shown in FIG. 6.

DESCRIPTION OF THE PREFERRED EMBODIMENTS

Figure 1A:
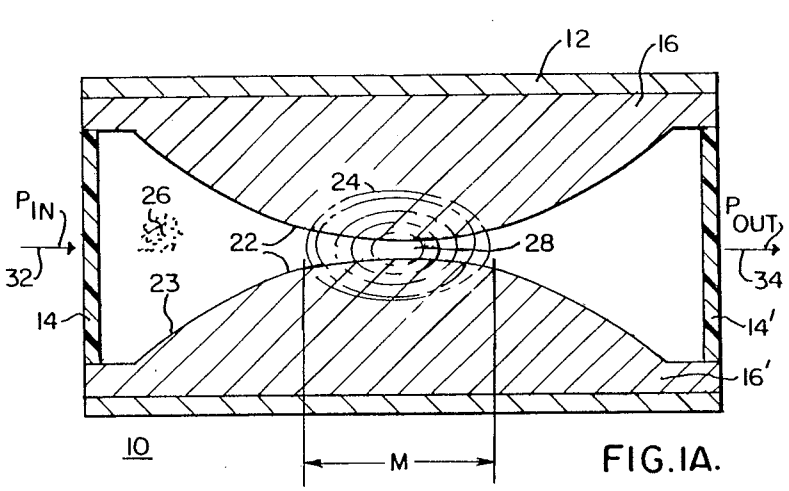
FIG. 1A is cross-section IA—IA of the preferred embodiment shown in FIG. 1, a wide band millimeter wave, fin-line gas discharge receiver protector.
Figure 1B:
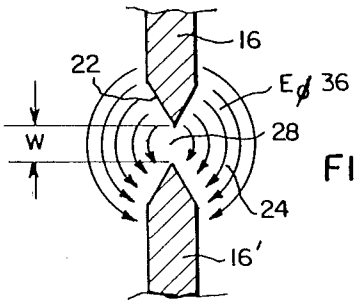
FIG. 1B is a plan view of the electric fields, $E_\phi$ in the gas discharge region, of width "w" between the fins of the wide band millimeter wave, fin-line, gas discharge device having tapered fins for electric field enhancement, and low insertion loss.
Figure 1:
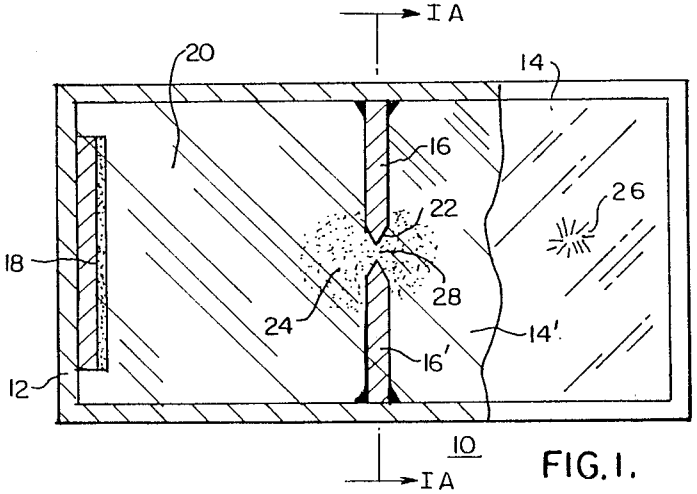
FIG. 1 is a plan view illustrating one embodiment, a wide band millimeter wave, fin-line, gas discharge receiver protector having cross-section IA—IA.

FIG. 1, is a plan view of one preferred embodiment of the invention a wide band, millimeter wave, fin-line gas discharge receiver protector 10. This receiver protector 10 having waveguide housing 12, is hermetically sealed, by low loss dielectric window, for example; mica windows 14, 14' sealed at each end of the rectangular waveguide housing 12. Planar metal fins 16, 16' are mounted within the waveguide housing 12 and run longitudinally within the body cavity of the rectangular housing 12. A radioactive primer 18, is positioned parallel to the planar metal fins 16, 16' and continuously emits free electrons 20 within the cavity formed by the rectangular housing 12. The planar metal fins 16, 16' are positioned one above the other, longitudinally throughout this body cavity. Both fins 16, 16' have bevelled edges 22, and form the narrowest discharge gap 28 in the center of the fins 16, 16' between the bevelled edges 22 of the planar metal fins 16, 16'. An ambient, inert gas 26 under low pressure is used in this embodiment to create gas discharge between the metal fins 16, 16'. The inert gas does not react with the metal fins and the metal housing. A discharge region 24 is therefore formed within the evacuated chamber housing 12, between the two planar metal fins 16, 16'.

FIG. 1A is a cross-section IA—IA of the embodiment as shown in FIG. 1, a wide band, millimeter wave, fin-line gas discharge receiver protector 10. The rectangular housing 12 which is hermetically sealed has an input, thin (approximately 0.5 millinches) low loss dielectric, window 14, of for example mica, at the input end of the waveguide housing 12 and an output low loss dielectric window 14' at the opposing end of the rectangular vacuum sealed waveguide housing 12. This cross-section, IA—IA shows the planar metal fins 16, 16' in their longitudinal position within the waveguide housing 12. Lower fin 16', and upper fin 16 are separated by a discharge gap 28 and both 16, 16' have the bevelled edge 22 and taper 23 of a transitional region. During wide band, millimeter wave, fin-line, gas discharge receiver protector operation a discharge region 24 having a diameter M, in the discharge gap 28, occurs when free electrons emitted by the primer 18 are excited by incoming radio frequency power signals. Electrons are excited to higher energy levels by incident radio frequency waves. The ambient gas under pressure 26 in the waveguide housing 12, which is maintained as vacuum sealed by the two low loss dielectric mica windows 14, 14', is comprised of neutral gas molecules. These molecules gain energy from high energy electrons by collisions and a gas discharge occurs at certain incident power levels. Upon gas discharge in the discharge region 24, the high level incident radio frequency input signal 32 is greatly attenuated, and a very low level leakage signal results at the output 34 which is well below the burnout level of the radar receiver, or the low power solid state limiter which follows the receiver protector.

FIG. 1B a plan view of the electric fields, $E_\phi$, 36 in the gas discharge region 24, at the discharge gap 28, of the wide band, millimeter wave, fin-line gas discharge device 10. As shown in FIG. 1, the device 10 having tapered bevelled 23 fins 16, 16' produce electrical field, $E_\phi$, 36, due to the incident power signal as it occurs between the upper, sharp-edged, metal fin 16 and the lower sharp-edged metal fin 16'. Both of these sharp edged metal fins 16, 16' with beveled edge 22 produce in the discharge gap region 28 having gap, "W" between fins 16, 16', an intense electrical field $E_\phi$, 36 due to the sharp, bevelled edge configuration, which further contributes to the breakdown of gas in the gap.

Figure 2:
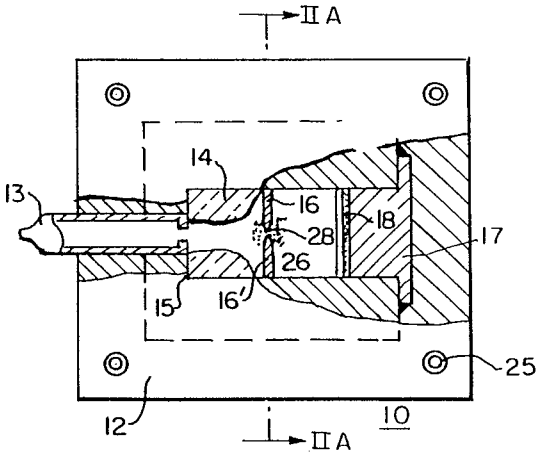
FIG. 2 is a plan view of a model of the wide band, millimeter wave, fin-line, gas discharge receiver protector having cross-section IIA—IIA.

FIG. 2 is a plan view of a wide band, millimeter wave, fin-line, gas discharge receiver protector 10 having a cross section IIA—IIA. The vacuum sealed waveguide housing 12 is filled with a low pressure gas 26 through a pinch-off tube 13. The input low loss dielectric window 14, is operable to receive the incident radio frequency (RF) millimeter wave power signals. The upper 16, and lower 16' bevelled, tapered metal fins, form their characteristic discharge gap 28. This narrow discharge gap 28, expands along the parallel and longitudinal length of the wide band, millimeter wave, fin-line, gas discharge receiver protector 10. The left radioactive substrate plug 17 is mounted upon and within the housing 12, directly opposite to the pinchoff tubing 13 along the narrow walls of the waveguide housing 12. This radioactive substrate plug, 17 is operable to contain a radioactive primer surface 18. A window flange, 15 contains the sealed input low loss dielectric window 14. The window flange, 15 acts as an input port having mounting means 25 which may or may not be threaded. The gas under pressure 26 which in this embodiment 10 is inert produces a gas discharge at low incident microwave power. Further, this gas is non-reactive to the metal housing, 12 and is operable to be primed by the free electrons given off by the primer 18.

Figure 2A:
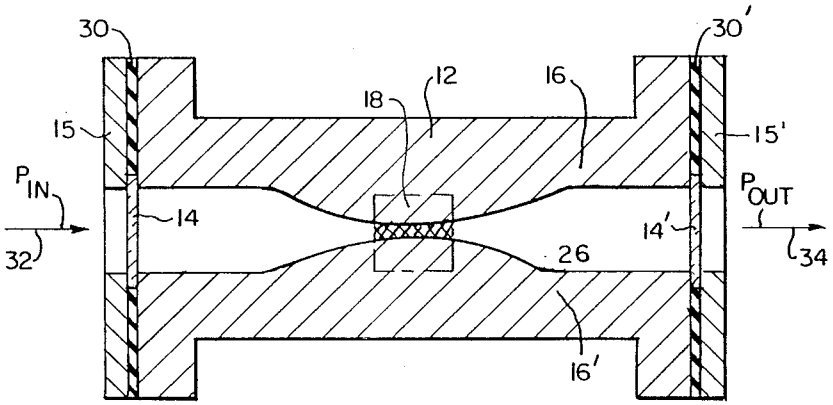
FIG. 2A is cross-section IIA—IIA of the preferred embodiment as shown in FIG. 2.

FIG. 2A is a cross section, IIA—IIA of the preferred embodiment 10 as shown in FIG. 2; a wide band, millimeter wave, fin-line, gas discharge device 10. Again, the vacuum sealed waveguide housing 12 creates a gas filled chamber, with the low loss dielectric windows 14, 14' located at opposing ends of the discharge device 10. Upper and lower, planar, tapered, bevelled fins 16, 16' are positioned parallel and longitudinally within the vacuum sealed waveguide housing 12. Window flange 15 contains the low loss dielectric window 14 operable to receive the radio frequency input signal 32, into the waveguide housing 12. The output window flange 15' contains the low loss output dielectric window 14' within the waveguide housing 12. Again, the discharge gap 28 occurs between the beveled, edges 22 of fins 16, 16'. The hermetically tight sealing of low loss dielectric windows 14, 14' with their flanges is accomplished by the vacuum tight joints 30 and 30'. The millimeter wave, radio frequency power input signal, 32 serves to breakdown the inert gas molecules proximate the gas 26 within the discharge gap 28 and as a result is greatly attenuated in the millimeter wave frequency range.

Figure 3A:
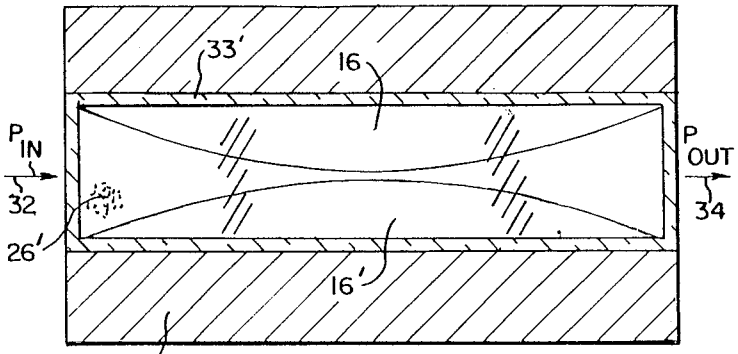
FIG. 3A is a cross-section IIIA—IIIA, of the fin-line receiver protector as in FIG. 3.
Figure 3:
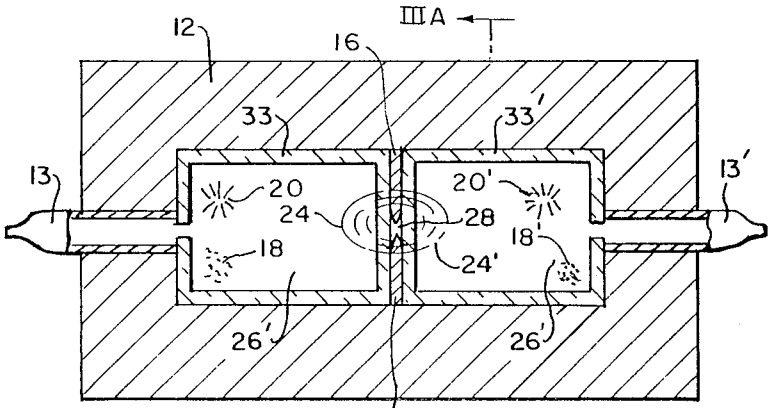
FIG. 3 is a plan view of an alternative embodiment, a wide band, fin-line, gas discharge receiver protector further comprising a quartz envelope and having cross-section IIIA—IIIA.

FIG. 3 is a plan view, of an alternative embodiment of this device, a wide band fin-line, gas discharge receiver protector, 9 containing two glass envelopes 33', having cross section IIIA—IIIA, as shown in FIG. 3A. This alternative embodiment, 9 of a wide band, a dual quartz envelope, receiver protector comprises; a waveguide housing 12, a radioactive dust source 18, 18' within the quartz envelope providing free electrons 20, 20'. A gas discharge gap 28 occurs within the housing 12, and between the upper 16, and lower 16', metallic printed fins. The gas discharge regions 24, 24' within the respective glass envelopes 33, 33' are operable to facilitate a gas discharge or electrical arc when the RF power input signal 32 transfers sufficient energy to reactive gas 26 and 26' respectively through collisions with excited electrons 20, 20' within the waveguide housing 12. In this embodiment, 9 sealed quartz envelopes 33 and 33' extend fully within the interior of the waveguide housing 12. The metallic fins 16 and 16' are printed on one of the outside faces of the thin quartz surfaces at the common wall between glass envelope 33 and 33'. The quartz envelopes 33 and 33' maintain a protective shell between a gas 26, 26' and the waveguide housing 12. This separation of the reactive gas 26, 26' from the waveguide housing 12 greatly increases the operational life of the wideband receiver protector g, compared to the all metal vacuum sealed housing.

FIG. 3A is a cross-section IIIA—IIIA of the fin-line receiver protector, 9 as shown in FIG. 3. This alternative embodiment, wide band, fin-line, millimeter wave low loss dielectric envelope device, 9 comprises a hermetically sealed waveguide housing 12. Upper and lower metallic printed fins 16, 16' are isolated from gases 26, 26' and are fully enclosed and extend parallel, longitudinally for the length of the waveguide housing 12. The reactive gases 26, 26' under pressure are introduced into the quartz envelopes 33, 33' after their evacuation prior, to the gas fill by means of pinchoff tubing 13, 13'. The millimeter wave input power RF signal, 32 is operable to create the gas discharge in the presence of free electrons 20, 20' and the reactive gases 26 and 26'. The gas discharge regions 24, 24' are created by the gas discharges proximate the gap 28 between the metallic printed fins 16, 16'. These discharges greatly attenuate the input incident signal 32 thereby protecting the device following the receiver protector 9 at the output location 34. This embodiment of receiver protector 9 is most useful for wide band protection using halogen fast recovery gases.

Figure 4A:
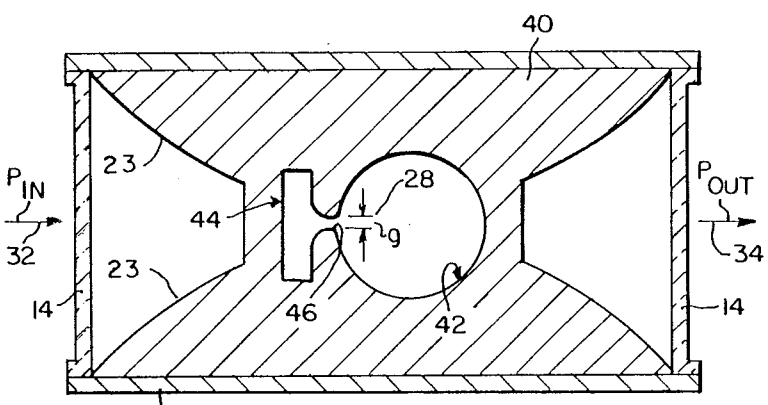
FIG. 4A is a cross-section IVA, IVA of the single stage narrow band fin-line gas discharge receiver protector as shown in the embodiment in FIG. 4.
Figure 4:
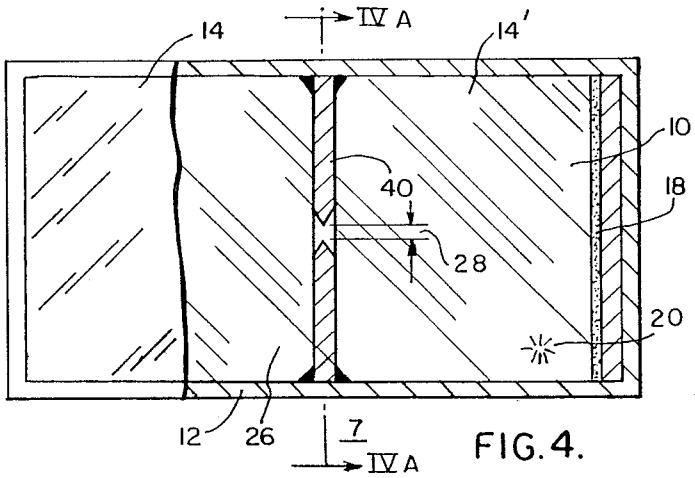
FIG. 4 is a plan view of a further embodiment of the disclosed .device, a single stage, narrow band, fin-line, gas discharge receiver protector having cross-section IVA—IVA.

FIG. 4 is a plan view of yet another embodiment exemplary of the device. A single stage, narrow band, fin-line, gas discharge, receiver protector having cross section IVA-IVA is shown in FIG. 4. This single stage, narrow band, fin-line, gas discharge receiver protector 7 comprises; a vacuum sealed, waveguide housing 12 having high power, low loss dielectric windows 14, 14', a single right side mounted radioactive primer 18 operable to emit free electrons 20, into an inert gas 26 at low pressure. An example of such an inert gas would be krypton or argon. This device 7, further comprises a unique planar metal fin 40. This single fin 40, has a novel orifice pattern making the device, 7 operable at a lower firing threshold in comparison with the wide band gas stage, as shown in FIG. 1. FIG. 4 shows a partial cutaway view to make visible the discharge gap 28.

FIG. 4A is cross section IVA-IVA of the single stage, narrow band, fin-line, gas discharge receiver protector, 7 as shown in FIG. 4. This single stage, fin-line, gas discharge, receiver protector 7 comprises; hermetically sealed waveguide housing 12, radio frequency power input/output low loss dielectric windows 14, 14', and a single planar metal fin 40 mounted longitudinally within hermetically sealed chamber housing 12. The waveguide to fin-line tapers 23, facilitate input and output ports for the millimeter wave, radio frequency signals. Further, this device utilizes inert gas 26, under low pressure: for example at a pressure of ten Torr. The gap discharge area 28 occurs in the embodiment at a point within a circular resonator 42, with tuning element 44. This tuning element 44, is a narrow fin-line stub. Sharp beveled edge 46, within the gap discharge region 28 on the resonator 42 serves as the focal point for the gas discharge breakdown. As more clearly seen in FIG. 4, this low pressure gas such as krypton, in the ten Torr pressure range would be operable to breakdown within the vacuum filled chamber when the waveguide housing 12 receives a radio frequency input signal 32 in the millimeter wave range of sufficient power as to provide sufficient energy to the gas molecules through collisions with the primed electrons 20 emitted from the radioactive primer, producing an arcing discharge at edge gap 46. In FIG. 4A, this discharge region 28 is within the resonator 42. The presence of the gas discharge greatly attenuates the RF power input signal 32, to protect the radar receiver placed after the receiver protector.

Figure 4B:
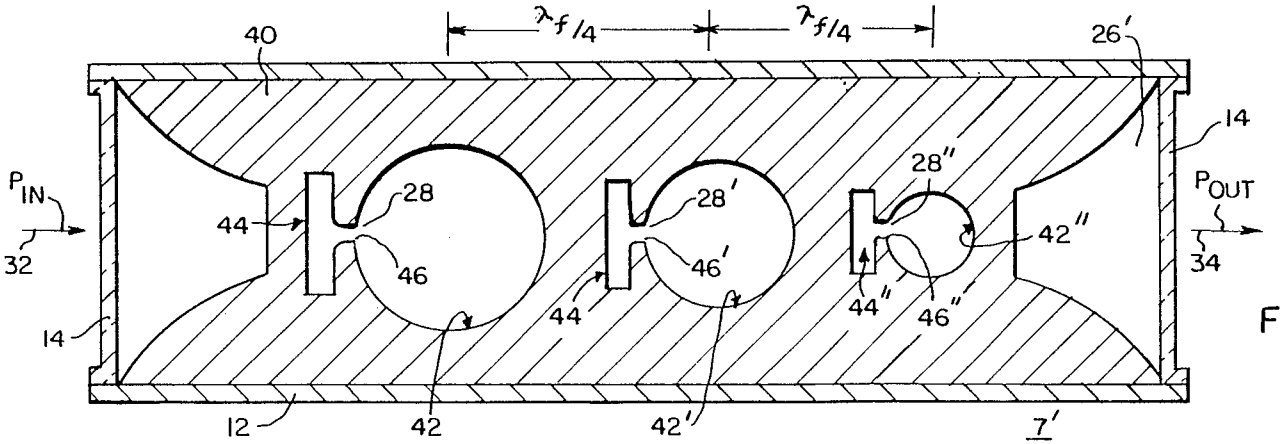
FIG. 4B is a sectional on other embodiment, view of multi-stage, narrow band, fin-line gas discharge receiver protector having three stages with low, medium and high firing thresholds.

FIG. 4B an alternative embodiment of cross section IVA—IVA of FIG. 4, is a sectional view, of a multistage narrow band, fin-line, gas discharge receiver protector 7' having three resonators, 42, 42', 42''. This multi-stage, narrow band, fin-line gas discharge device 7' again has a hermetically sealed, waveguide housing 12, radio frequency input and radio frequency output low loss dielectric windows 14, 14', respectively. The gas breakdown process is initiated by the free electrons 20 emitted by the primer lB in the presence of the incident RF input signal until the breakdown of the gas 26 occurs. In this embodiment the three resonators, first resonator 42, second resonator 42' and third resonator 42'' act as three distinct gas discharge areas at beveled discharge edged gaps 46, 46', and 46''. These three resonators 42, 42' and 42'' are spaced approximately a quarter of a wavelength ($\lambda/4$) apart in the planar metal fin 40.

This multiple resonator embodiment 7', as shown in FIG. 4B is particularly operable in the narrow band, fin-line, gas stage region. The discharge gaps 46, 46' and 46'' in resonators 42, 42' and 42'' thereby provide discharge gap regions 28, 28' and 28'', respectively. Any input millimeter wave power input signal 32 incident to the receiver protector 7', and having sufficient power would be greatly attenuated while passing through the three resonator cavities 42, 42' and 42'' when the radioactive primer 18 emits free electrons 20 to fire resonator 46'' while the resonator 46' and 46 are without the radioactive primer. Resonator 46'' fires first at the lowest RF input signal power while resonators 46' and 46 fire at successively higher RF input signal power levels. Therefore, the overall input signal attenuation due to three stages is significantly higher than a single stage.

Figure 5A:
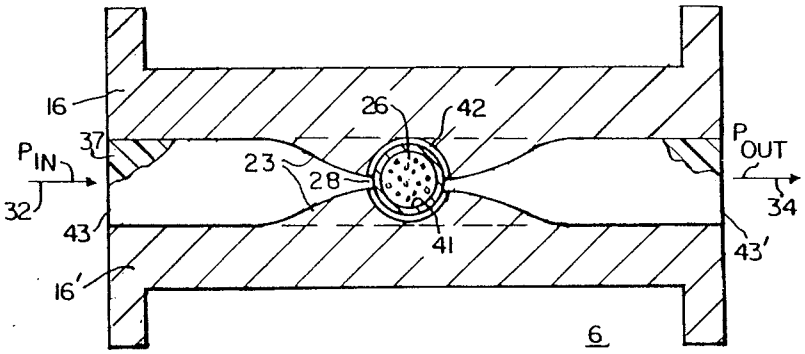
FIG. 5A is a cross-section VA—VA of the fin-line protector as shown for the low pressure fin-line embodiment in FIG. 5.
Figure 5:
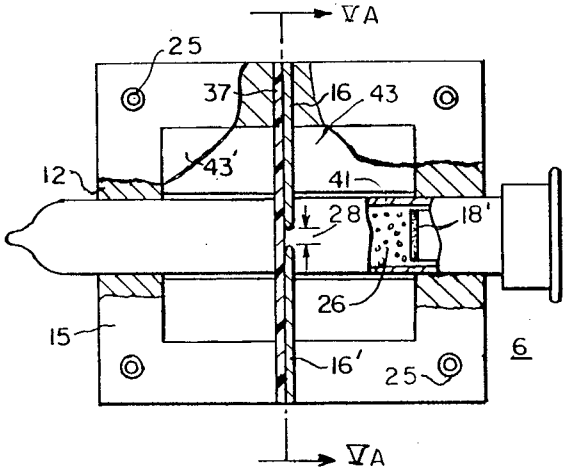
FIG. 5 is a plan view of a tapered, circular iris, sealed quartz, low pressure, fin-line, narrowband, gas discharge receiver protector having cross-section VA—VA.

FIG. 5 is a plan view, of a tapered circular iris, sealed quartz, low pressure, fin-line, narrow band, gas discharge receiver protector, 6 having cross section VA—VA. The dielectric windows are eliminated in this embodiment 6 and a sealed quartz tube 41 functions in its place. The upper 16 and lower 16' planar fins of this embodiment 6 are (Cu) copper plated upon a thin, low loss dielectric substrate material 37. In this embodiment 6, the single stage narrow band fin-line with a hermetically sealed quartz vial 41, in a circular resonator 42, maintains a separation between the metallized substrate and the reactive gas 26' via the hermetically sealed quartz vial 41. Instead of a radioactive primer pad, a radioactive particle deposition 18' exists on the interior of the quartz vial, 41. Again, waveguide housing 12 contains the fins 16, 16' on substrate 37. Flange 15 creates an opening for input signal through the receiver protector 6. Threaded means 25 mounts flange 15 to waveguide housing 12.

FIG. 5A is a cross section VA—VA of the fin-line receiver protector as described in FIG. 5. FIG. 5A shows a single stage, narrow band, fin-line with quartz vial receiver protector, 6 having an upper 16 and lower 16' planar metallic fins printed upon a thin low loss dielectric substrate 37. The reactive gas 26 under pressure which is reactive in nature, is fully enclosed by the hermetically sealed, quartz vial, 41 within the single iris 42 forming a single stage receiver protector. The input window flange 15 is mounted to the waveguide housing 12 by threaded connecting means 25, as shown in FIG. 5. The waveguide to fin-line transition is incorporated by the tapers 23. The input waveguide opening 43 located within window flange 15 is operable to input the radio frequency input signal, 32 and to permit this signal 32 to transmit through waveguide opening 43' as an output signal 34. In the event of a sufficiently strong input signal 32, a gaseous discharge located within the quartz hermetically sealed, vial, 41 proximate the gap region 28 will highly attenuate the input signal 32 protecting any device following the receiver protector 6 by attenuating output signal 34.

FIG. 6 is an isometric view of an S-band, (approximately 2.6–3.95 G.Hz) plasma stage, receiver protector device 5 having as a single resonator a sealed, quartz vial 41. The hermetically sealed, quartz vial 41 with a dusting of radioactive primer 18 incorporated within the quartz vial 41 resides in an orifice cut within the body of the alumina substrate 50, having a flanged metallic surface layer 52. The slot resonator 48 is cut within the metallic surface layer 52, proximate the quartz vial 41. The input RF signal 32 enters the receiver protector 5 via coaxial cable 64 and coaxial cable connector 66 through the input connector 35. Input signal connector 35 with input connector pin 70 is interconnected to input microstrip 45 by soldering or conductive epoxy. Input signal 32 enters the receiver protector 5 through input connector 35 which is mounted to the flange of the surface layer 52 via threaded means 60 which passes through orifice 62. Input signal 32 moves along microstrip 45 which is isolated from metallic surface 52 by alumina substrate layer 50. This input signal 32 passes proximate quartz vial 41 beneath the slot resonator 48 cut into the metallic surface layer 52. Quartz vial 41 comprises a gas 26 and radioactive primer dust 18. A gas discharge in this vial 41, would attentuate input signal 32, and the signal would not pas through the receiver protector 5. If input signal 32 is not sufficiently powerful to produce a gas discharge within vial 41, the input signal 32 will exit the receiver protector without being attentuated through output connector 35'. Output connector 35' is mounted upon metallic surface 52 via threaded means 60' through orifice 62'. The output signal 34 then passes through coaxial connector 66' and coaxial cable 64'.

FIG. 6A is a top plan view of FIG. 6 as viewed from above the quartz vial 41 region at section VIA—VIA of FIG. 6. In this embodiment of the receiver protector 5 the gas discharge occurs in the quartz vial or tube 41 at the gas discharge region 24 within the vial 41 or tube, which contains a gas 26 under pressure. The electric field lines, $E_{100}$, 36 are shown in their circular configuration with the force, $E_{100}$, 36 converging on the gap region 28. Free electrons 20, are given off into the quartz vial or tube, 41 by a layer of radioactive particles 18 which serves as a radioactive primer. The slot resonator 48 is cut into the metal plate 52 bonded upon alumina substrate 50. This alumina substrate 50 maintains electrical isolation between the input microstrip 45, output microstrip 45' and metallic surface layer 52. Input signal 32 can be seen entering the quartz vial or tube 41 region through input microstrip 45 which passes adjacent to quartz vial 41. If input signal 32 is of sufficient power, then the electron excitation of the gas 26 by the primer 18 will result in a gas discharge centered in the gas discharge area 24, proximate the gap region 28 severely attenuating signal 32. This severely attenuated signal 32 will not exit via microstrip 45' as output signal 34.

FIG. 6B is an exploded side view of this embodiment 5 which utilizes a reactive gas 26 under pressure confined within a quartz vial or tube 41 to achieve radar receiver protection. The radioactive primer 18 in this embodiment 5 comprises radioactive particles "dusted" on the inside surface of the sealed quartz vial 41. Free electrons 20 are given off by the radioactive particles 18 into the quartz vial 41. A radio frequency signal 32 enters the receiver protector 5 via coaxial cable 64 and coaxial connector 66 through the input connector 35. Connector 35 is mounted to flanged metallic surface 52 via a threaded connector means 60 which passes through connector 35 and orifice 62 to mechanically interconnect connector 35 and metal plate 52. Alumina substrate 50 is shown in FIG. 6B as operable to be bonded to the underside of metallic surface 52. An input microstrip 45 is applied to the underside of alumina substrate 50 bonded to input signal pin 70. Input signal pin 70 directly interconnects the input coaxial connector 66 through a TEFLON sleeve 68. When an input signal 32 enters the receiver protector 5 through the input connector 35 it passes along the input microstrip 45 beneath alumina substrate 50 until it is adjacent quartz vial 41. If the input signal 32 is of sufficient power, the free electrons 20 emitted by the radioactive particles 18 within the vial or tube 41 and proximate the quartz vial or tube 41 result in a spontaneous discharge of the gas molecules 26 at the gap region 24 proximate the gap region 28 formed within the metallic surface layer 52. This gas discharge would severely attenuate the input signal 32, thereby protecting the receiver or other devices following the protector. If the input signal 32 is not of sufficient power to produce a spontaneous gas discharge, then the input signal 32 will pass along input microstrip 45, pass through quartz vial or tube 41 unattenuated and finally out via microstrip 45', resulting in output signal 34. The output connector 35' is mounted to the flanged metallic layer 52 via threaded means 60' which passes through orifice 62' within output connector 35'. A TEFLON lining 68' surrounds output pin 70' which is bonded via solder or conductive epoxy to output microstrip 45'. Output pin 70' receives output signal 34, passes that signal 34 through output connector 35' through coaxial connector 66', and finally to coaxial cable 64' This receiver protector is operable in the frequency range from L to X-Band (1.126 Hz - 2.46 Hz).

Numerous variations may be made in the above-described combination and different embodiments of this invention may be made without departing from the spirit thereof. Therefore, it is intended that all matter contained in the foregoing description in the accompanying drawing is illustrative and not in the limiting sense.

We claim:

1. A millimeter wave, fin-line, radar receiver protector, comprising:

a hermetically sealed, rectangular housing, said rectangular housing having four sides and a first and a second end;

first and second dielectric windows fixedly mounted at said first and said second ends of said housing, respectively said first and said second dielectric windows being operable to receive radio frequency signals, and transmit said radio frequency signals through said millimeter wave, fin-line, radar receiver protector;

a radioactive primer, mounted within said rectangular housing, said radioactive primer being operable to emit free electrons within said housing;

an inert gas contained within said hermetically sealed, rectangular housing, said inert gas operable to be excited by said free electrons emitted from said radioactive primer, and said radio frequency signals; and, first and second bevelled, fin-line tapered fins mounted within said housing, said first fin mounted onto one of said sides of said housing and said second fin mounted onto an opposing side of said housing, such that said first fin and said second fin are parallel and directly opposed to one another forming a discharge gap, said first and said second fins are bevelled their entire length, said discharge gap being operable to facilitate a gas discharge across said discharge gap when said radio frequency signals enter said millimeter wave, fin-line, radar receiver protector, and whereby said radio frequency signals are attenuated.

2. A millimeter wave, fin-line, radar receiver protector, as in claim 1, wherein said hermetically sealed, rectangular housing is comprised of metal.

3. A millimeter wave, fin-line, radar receiver protector, as in claim 1, wherein said first and said second dielectric windows are comprised of mica.

4. A millimeter wave, fin-line, radar receiver protector, as in claim 1, wherein said first and said second bevelled, tapered fins are comprised of metal.

5. A millimeter wave, fin-line, radar receiver protector, as in claim 1, wherein said inert gas is maintained at a pressure of up to ten Torr.

6. A millimeter wave, fin-line, radar receiver protector, operable to protect a radar receiver from received incident radio frequency signals, comprising:

first and a second metal flanged rectangular housing portions, said first and said second metal flanged rectangular housing portions being operable to form a hermetically sealed, rectangular housing comprising four sides and a first and a second end;

a radioactive primer means, said radioactive primer means fixedly mounted to at least one of said four sides within said rectangular housing formed by said first and said second metal flanged rectangular housing portions, said radioactive primer being operable to emit free electrons within said hermetically sealed, rectangular housing;

an inert discharge gas, said inert discharge gas being fully contained within said hermetically sealed, rectangular housing, said inert discharge gas operable to be excited by said free electrons emitted within said hermetically sealed, rectangular housing from said radioactive primer, and said received incident radio frequency signals;

a pinch-off exhaust tube, said pinch-off exhaust tube being fixedly mounted through at least one side of said four sides of said rectangular housing, said pinch-off exhaust tube being operable to evacuate and fill said hermetically sealed, rectangular housing with said inert discharge gas;

first and second dielectric windows, said first and said second dielectric windows being fixedly mounted at said first and said second ends, respectively within said hermetically sealed, rectangular housing, said first and said second dielectric windows being operable to receive said incident, radio frequency signals, and transmit said signals as radio frequency, output signals through said millimeter wave, fin-line, radar receiver protector;

first and second window flanges, said first and said second window flanges being fixedly mounted at said first and said second ends, respectively, of said hermetically sealed, rectangular housing, said first window and said second window flanges being fixedly mounted to said first and said second metal flanged rectangular housing portions, by a window flange connecting means; and first and second bevelled, fin-line tapered fins mounted within said housing, said first fin mounted onto one of said sides of said housing and said second fin mounted to another of said sides of said housing, said first fin and said second fin are parallel and directly opposed to one another within said hermetically sealed, rectangular housing, further said first and said second bevelled, fin-line tapered fins forming between them a discharge gap, said discharge gap being operable to facilitate a spontaneous gas discharge across said discharge gap when said incident radio frequency signals excite said free electrons emitted by said radioactive primer, said free electrons energizing said inert gas to a level of spontaneous discharge wherein said incident, radio frequency signals are attenuated.

7. A millimeter wave, fin-line, radar receiver protector, as in claim 6, wherein said first and said second dielectric windows are comprised of mica.

8. A millimeter wave, fin-line, radar receiver protector, as in claim 6, wherein said first and said second window flanges are comprised of metal.

9. A millimeter wave, fin-line, radar receiver protector, as in claim 6, wherein said first and said second bevelled, tapered fins are comprised of metal.

10. A millimeter wave, fin-line, radar receiver protector, comprising:

a rectangular housing, said rectangular housing having four sides and a first and a second open end;

first and second hermetically sealed, dielectric rectangular chambers, said first and said second hermetically sealed dielectric rectangular chambers being mounted within said rectangular housing, proximate one another, said first and said second hermetically sealed dielectric rectangular chambers having four sides and first and second ends, said first and said second hermetically sealed, dielectric rectangular chambers touching at one of said four sides;

first and second radioactive primers, said first and said second radioactive primers being layered within said first and said second hermetically sealed, dielectric rectangular chambers respectively, said first and said second radioactive primers being operable to emit free electrons within said first and said second hermetically sealed, dielectric rectangular chambers;

a discharge gas, said discharge gas being fully contained within said first and said second hermetically sealed, dielectric rectangular chambers, said discharge gas operable to be excited by said free electrons emitted within said first and said second hermetically sealed, dielectric rectangular chambers from said first and said second radioactive primers, and said received incident radio frequency signals; and first and second bevelled, fin-line tapered fins mounted within said rectangular housing, said first and said second bevelled, fin-line tapered fins being layered between said first and said second hermetically sealed, dielectric chambers at said one of said four sides where said first and said second hermetically sealed, dielectric chambers, are proximate, said first fin and said second fin are parallel and directly opposed to one another within said rectangular housing, further said first and said second bevelled, fin-line tapered fins forming between them a discharge gap, said discharge gap being operable to facilitate a spontaneous gas discharge across said discharge gap when said received incident radio frequency signals enters said millimeter wave, fin-line, radar receiver protector, exciting said free electrons emitted by said first and said second radioactive primer, said free electrons energizing said discharge gas to a level of spontaneous discharge wherein said received, incident radio frequency signals are attenuated.

11. A millimeter wave, fin-line, radar receiver protector as in claim 10, wherein said rectangular housing is comprised of metal.

12. A millimeter wave, fin-line, radar receiver protector as in claim 10, wherein said first and said second hermetically sealed dielectric rectangular chambers are comprised of quartz.

13. A millimeter wave, fin-line, radar receiver protector as in claim 10, wherein said first and said second bevelled, tapered fins mounted between said first and said second hermetically sealed dielectric rectangular chambers are comprised of metal plating.

14. A millimeter wave, fin-line, radar receiver protector as in claim 10, wherein said discharge gas is an inert gas.

15. A millimeter wave, fin-line, radar receiver protector as in claim 10, wherein said discharge gas is a reactive gas.

16. A single stage, narrow band, fin-line, radar receiver protector, comprising:

an airtight rectangular housing, said housing having four sides and a first and a second end;

first and second dielectric windows, said first and said second dielectric windows being mounted at said first and said second ends, respectively within said airtight, rectangular housing, said first and said second dielectric windows being operable to receive and transmit incident radio frequency signals as output signals through said single stage, narrow band, fin-line, radar receiver protector;

a radioactive primer, said radioactive primer mounted within said rectangular housing, said radioactive primer being operable to emit free electrons within said airtight, rectangular housing;

an inert, discharge gas, said inert, discharge gas being fully contained within said hermetically sealed, rectangular housing, said inert, discharge gas operable to be excited by said free electrons emitted within said hermetically sealed, rectangular housing from said radioactive primer, and said incident radio frequency signals; and a fin-line tapered, planar fin, said tapered, planar fin having a fin-line resonator, and a tuning element means cut into said fin, said tuning element and said fin-line resonator forming a discharge gap between said fin-line resonator and said tuning element, said fin-line tapered, planar fin mounted within said airtight, rectangular housing, further said discharge gap being operable to facilitate a spontaneous gas discharge across said discharge gap at a lower firing threshold when said incident, radio frequency signal enters said single stage, narrow band, fin-line radar receiver protector, exciting said free electrons emitted by said radioactive primer, said free electrons energizing said discharge gas to a level of spontaneous discharge across said discharge gap wherein said received, incident radio frequency signals are attenuated.

17. A single stage, narrow band, fin-line, radar receiver protector, as in claim 16, wherein said hermetically sealed, rectangular housing is comprised of metal.

18. A single stage, narrow band, fin-line, radar receiver protector, as in claim 16, wherein said first and said second dielectric windows are comprised of mica.

19. A single stage, narrow band, fin-line, radar receiver protector, as in claim 16, wherein said planar fin is comprised of metal.

20. A multi-stage, narrow band, fin-line, radar receiver protector, comprising:

a hermetically sealed, rectangular housing, said rectangular housing having four sides and a first and a second end;

first and second dielectric windows, said first and said second dielectric windows being mounted at said first and said second ends, respectively within said hermetically sealed, rectangular housing, said first and said second dielectric windows being operable to receive and transmit incident radio frequency, signals through said multi-stage, narrow band, fin-line, radar receiver protector;

a radioactive primer, said radioactive primer mounted within said rectangular housing, said radioactive primer being operable to emit free electrons within said hermetically sealed, rectangular housing;

an inert discharge gas, said inert discharge gas being fully contained within said hermetically sealed, rectangular housing, said inert discharge gas operable to be excited by said free electrons emitted within said hermetically sealed, rectangular housing from said radioactive primer, and said incident radio frequency signals; and a planar fin-line tapered, fin, said planar tapered, fin being mounted within said hermetically sealed, rectangular housing, further said planar fin-line tapered, fin having a multiplicity of fin-line resonators of various sizes, and a multiplicity of tuning elements means of various sizes for each of said fin-line resonators, said multiplicity of fin-line resonators and corresponding multiplicity of tuning elements means being spaced apart on said planar tapered fin, one quarter wavelength apart, said multiplicity of fin-line resonators and said multiplicity of tuning element means forming a corresponding multiplicity of discharge gaps, further said discharge gaps being operable to facilitate a series of spontaneous gas discharges across said discharge gaps at different firing thresholds said incident radio frequency signals entering said multi-stage, narrow band, fin-line radar receiver protector, exciting said free electrons emitted by said radioactive primer, said free electrons energizing said discharge gas to a level of spontaneous discharge wherein said incident radio frequency signals are attenuated at a multiplicity of firing thresholds.

21. A multi-stage, narrow band, fin-line gas radar receiver protector, as in claim 20, wherein said hermetically sealed, rectangular housing is comprised of metal.

22. A multi-stage, narrow band, fin-line radar receiver protector, as in claim 20, wherein said first and said second dielectric windows are comprised of mica.

23. A multi-stage, narrow band, fin-line radar receiver protector, as in claim 20, wherein said planar tapered, fin is comprised of metal.

24. A single stage, narrow band, fin-line radar receiver protector, comprising:

a rectangular housing, said rectangular housing having four sides and a first and a second open end;

a dielectric substrate, said dielectric substrate mounted within said rectangular housing;

first and second tapered, bevelled fins, said first and said second tapered, bevelled fins mounted upon said dielectric substrate such that said first and said second tapered, bevelled fins are parallel and opposed to each other upon said dielectric substrate;

a circular iris, said circular iris being cut within said dielectric substrate perpendicular to said first and said second tapered, bevelled fins, further said circular iris and said first and said second tapered, bevelled fins forming a discharge gap;

a hermetically sealed, dielectric tube, said hermetically sealed, dielectric tube interfitting through said circular iris proximate said discharge gap;

a radioactive primer, said radioactive primer layered within said hermetically sealed, dielectric tube proximate said first and said second tapered, bevelled fins, said radioactive primer operable to emit free electrons during said radar receiver protector operation; and a discharge gas, said discharge gas being contained within said hermetically sealed, dielectric tube, said discharge gas operable to be excited by said free electrons, whereby said discharge gap facilitates a spontaneous gas discharge within said hermetically sealed dielectric tube across said discharge gap when said incident radio frequency signals excite said free electrons emitted by said radioactive primer, said free electrons energizing said discharge gas to a level of spontaneous discharge wherein said incident radio frequency input signals are attenuated.

25. A single stage, narrow band, fin-line radar receiver protector, as in claim 24, wherein said rectangular housing is comprised of metal.

26. A single stage, narrow band, fin-line radar receiver protector, as in claim 24, wherein said dielectric substrate is comprised of mica.

27. A single stage, narrow band, fin-line radar receiver protector, as in claim 24, wherein said first and said second tapered, bevelled fins are comprised of metal.

28. A single stage, narrow band, fin-line radar receiver protector, as in claim 27, wherein said first and said second tapered, bevelled fins are comprised of copper (Cu).

29. A single stage, narrow band, fin-line radar receiver protector, as in claim 27, wherein said discharge gas is an inert gas.

30. A single stage, narrow band, fin-line radar receiver protector, as in claim 27, wherein said discharge gas is a reactive gas.

31. A single stage, S-band, fin-line radar receiver protector, comprising:

a metallized top layer, said metallized top layer having an iris cut within said top layer, said iris forming a discharge gap;

an alumina substrate layer, said alumina substrate layer bonded to the underside of said metallized top layer, said alumina substrate layer having an iris cut within said substrate layer;

a hermetically sealed dielectric tube, said hermetically sealed dielectric tube slideably interfitting within said iris within said metallized top layer and said iris cut within said alumina substrate layer;

a discharge gas, said discharge gas contained within said hermetically sealed dielectric tube, said discharge gas comprising discharge gas molecules;

a radioactive primer, said radioactive primer contained within said hermetically sealed dielectric tube, said radioactive primer operable to emit free electrons within said hermetically sealed dielectric tube;

an input microstrip, said input microstrip bonded to the underside of said alumina substrate layer, said input microstrip mounted proximate said discharge gap;

an output microstrip, said output microstrip bonded to the underside of said alumina substrate layer on the opposite side of said airtight dielectric tube from said discharge gap;

an input signal connector, said input signal connector mounted to said metallized top layer, said input signal connector operable to input a radio frequency signal, whereby said input signal connector is electrically interconnected to said input microstrip; and an output signal connector, said output signal connector mounted to said metallized top layer, said output signal connector being electrically interconnected to said output microstrip and operable to emit said input signal as an output signal except where said input radio frequency signal excites said free electrons, energizing said gas molecules facilitating a gas discharge proximate said discharge gap, said gas discharge attenuating said input signal.

32. A single stage, S-band, fin-line radar receiver protector, as in claim 29, wherein said discharge gas is inert.

33. A single stage, S-band, fin-line radar receiver protector, as in claim 29, wherein said discharge gas is reactive.

34. A passive, radar receiver protector, comprising:

a hermetically sealed, gas containment means, said hermetically sealed, gas containment means operable to contain a discharge gas, said discharge gas comprising a multiplicity of gas molecules;

a discharge gap means, said discharge gap means being proximate and cooperatively associated with said hermetically sealed, gas containment means, further said discharge gap means being formed by tapered, bevelled metallic fins mounted parallel and opposed to one another on a common low-dielectric substrate surface;

a radioactive primer means, said radioactive primer means operable to emit free electrons within said hermetically sealed, gas containment means; and a means for inputting an incident radio frequency signal to said radar receiver protector, said incident radio frequency signal operable to be attenuated by a gas discharge within said gas containment means proximate said discharge gap means, whereby said free electrons are excited by said incident radio frequency signal, said free electrons and said incident radio frequency signal energizing said gas molecules, facilitating said gas discharge.

35. A passive, radar receiver protector, as in claim 34, wherein said discharge gas is reactive.

36. A passive, radar receiver protector, as in claim 34, wherein said discharge gas is inert.

37. A passive, radar receiver protector, comprising:

a hermetically sealed, gas containment means, said hermetically sealed, gas containment means operable to contain a discharge gas, said discharge gas comprising a multiplicity of gas molecules;

a discharge gap means, said discharge gap means being proximate and cooperatively associated with said hermetically sealed, gas containment means, further said discharge gap means being formed by a slot in a metallic surface element on a low-dielectric substrate surface;

a radioactive primer means, said radioactive primer means operable to emit free electrons within said hermetically sealed, gas containment means; and a means for inputting an incident radio frequency signal to said radar receiver protector, said incident radio frequency signal operable to be attenuated by a gas discharge within said gas containment means proximate said discharge gap means, whereby said free electrons are excited by said incident radio frequency signal, said free electrons and said incident radio frequency signal energizing said gas molecules, facilitating said gas discharge.

38. A passive, radar receiver protector, as in claim 37 wherein said discharge gas is reactive.

39. A passive, radar receiver protector, as in claim 37, wherein said discharge gas is inert.

* * * * *